US005867857A

United States Patent [19]

Crouser et al.

[11] Patent Number: 5,867,857

[45] **Date of Patent: *Feb. 9, 1999**

[54] CARPET EXTRACTOR FLUID SUPPLY SYSTEM

[75] Inventors: Darwin S. Crouser, Canton; Lynn A. Frederick, Brady Lake; Edgar A. Mauer, Canton, all of Ohio

[73] Assignee: The Hoover Company, North Canton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 679,453

[22] Filed: Jul. 9, 1996

Related U.S. Application Data

[60] Provisional application No. 60/002,207 Aug. 11, 1995.

[51] Int. Cl. [6] ..... A47L 11/30

[52] U.S. Cl. ..... 15/50.1; 15/320; 15/385

[58] Field of Search ..... 15/50.1, 320, 321, 15/385

[56] References Cited

U.S. PATENT DOCUMENTS

| | | | |
|---|---|---|---|
| 2,217,617 | 10/1940 | Conway | 15/50.1 |
| 3,028,615 | 4/1962 | Helm . | |
| 3,040,350 | 6/1962 | Helm . | |
| 3,181,190 | 5/1965 | Dix et al. | 15/320 X |
| 3,189,930 | 6/1965 | Tuthill, Jr. | 15/320 |
| 3,444,577 | 5/1969 | Koland | 15/50.1 |
| 3,644,960 | 2/1972 | Danzig | 15/385 X |
| 3,688,339 | 9/1972 | Vincent et al. | 15/387 |
| 3,851,349 | 12/1974 | Lowder | 15/50.1 |
| 3,947,911 | 4/1976 | Meyerhoefer | 15/50 R |
| 4,000,538 | 1/1977 | Tissier | 15/320 |
| 4,353,145 | 10/1982 | Woodford | 15/321 |
| 4,490,873 | 1/1985 | Stratton | 15/49 R |
| 4,805,258 | 2/1989 | Sitarski et al. | 15/385 |
| 4,809,397 | 3/1989 | Jacobs et al. | 15/320 |
| 4,881,288 | 11/1989 | May et al. | 15/98 |
| 4,893,375 | 1/1990 | Girman et al. | 15/321 |
| 5,088,149 | 2/1992 | Berg et al. | 15/322 |

FOREIGN PATENT DOCUMENTS

| | | | |
|---|---|---|---|
| 791905 | 8/1968 | Canada | 15/14.1 |
| 1 434 270 | 12/1973 | United Kingdom . | |

*Primary Examiner*—Chris K. Moore

*Attorney, Agent, or Firm*—Renner, Kenner, Greive, Bobak, Taylor & Weber

[57] ABSTRACT

A gravity feed liquid cleaning solution supply system particularly suitable for use on an upright hot water carpet extractor having a free floating brush assembly is disclosed. The unique system generally comprises a stationary fluid supply manifold positioned above a free floating brush assembly having multiple laterally disposed rotary brushes rotatable about vertical axle shafts suspended from a laterally disposed brush support beam. The support beam includes open top troughs, one above each individual brush, into which liquid cleaning solution cascades from the overhead manifold. From each fluid trough, the cleaning solution is conveyed to the center cup of an associated rotary brush through a conduit integrally molded into the brush support beam. By this unique structure liquid cleaning solution is supplied to the free floating brush assembly without restricting the floating movement of the scrubbing brushes over the surface being cleaned.

13 Claims, 10 Drawing Sheets

FIG.-13
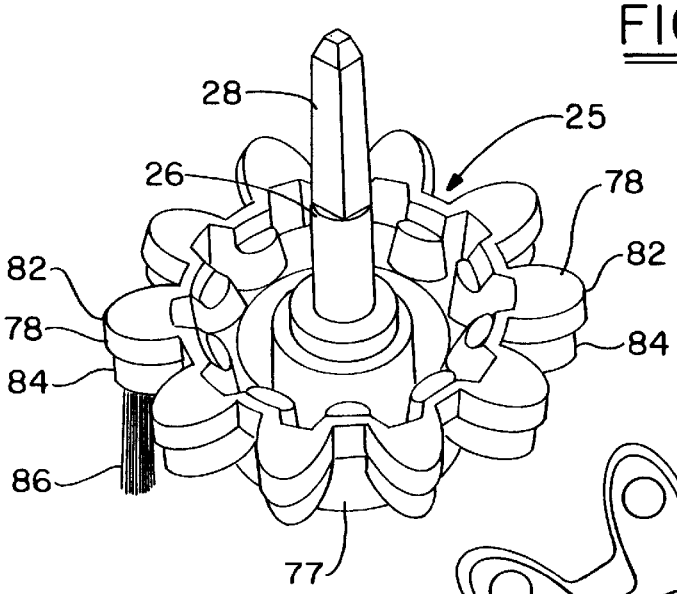
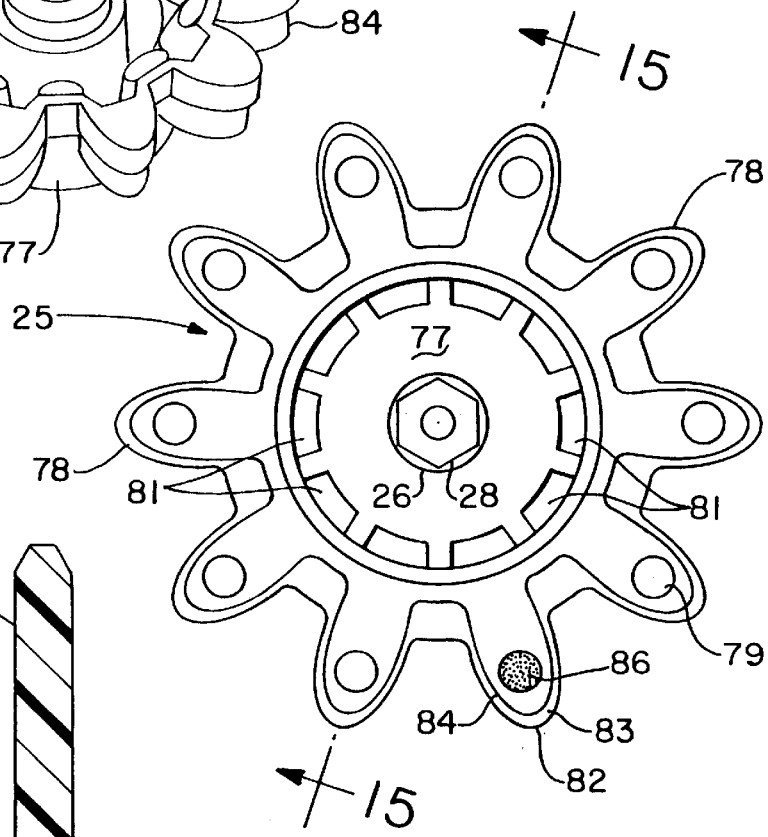
FIG.-14
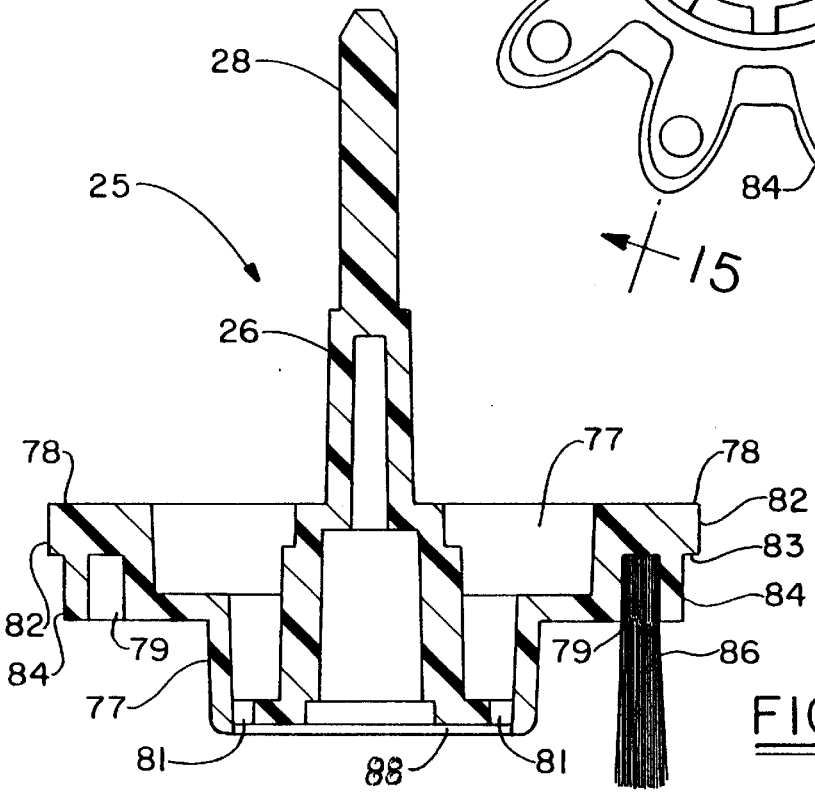
FIG.-15

CARPET EXTRACTOR FLUID SUPPLY SYSTEM

CROSS REFERENCE TO RELATED APPLICATION

This application claims the benefit of U.S. Provisional Application No. 60/002,207 filed Aug. 11, 1995.

BACKGROUND OF THE INVENTION

The present invention relates to a carpet extractor and more particularly to a cleaning solution supply system for use with an upright carpet extractor (of the type taught in co-owned U.S. Pat. No. 5,406,673) and having a multiplicity of air turbine powered carpet scrubbing brushes.

Heretofore carpet extractors having powered brushes to assist scrubbing of the surface being cleaned have generally affixed the powered brush and/or brushes to the main body of the machine in such a way that, except for the rotary motion of the brush, the brush assembly did not move relative to the main body. Thus the rotary action of the powered brush tends to lift the liquid suction nozzle upward and away from the surface being cleaned resulting in lost efficiency of the system as a whole.

BRIEF DESCRIPTION OF THE INVENTION

The present invention overcomes the above stated disadvantage of prior art extractors by disclosing a novel, free floating, powered, brush assembly and associated fluid supply system whereby the brush assembly is free to float atop the surface being cleaned in such a way that the brush assembly supports none of the extractor's weight nor imparts any forces to the machine that would otherwise tend to lift the liquid recovery suction nozzle upward from the surface being cleaned.

Disclosed herein is a pumpless, gravity flow, cleaning solution supply system particularly useful for supplying a steady flow of cleaning solution to a multiple number of free floating laterally disposed, cup-like, scrubbing brushes rotatable about vertically aligned and generally parallel axis of rotation.

The liquid cleaning solution flows from an elevated supply tank through an on-off control valve (similar to that as taught in U.S. Pat. No. 5,406,673) to a horizontally disposed distribution manifold affixed to the base module of a typical upright carpet extractor. The distribution manifold is positioned above a vertically movable, free floating, brush assembly having multiple laterally disposed carpet scrubbing brushes rotatable about a vertical axis. An elongate, trough-like, brush support beam extends the lateral width of the brush assembly having integrally molded, vertically aligned, spaced apart, cylindrical bearings each receiving therein a vertically directed axle shaft of a rotary scrubbing brush. The brush support beam is partitioned into open top, cleaning solution supply troughs, one generally positioned above each rotary brush. A conduit extends from the bottom floor of each cleaning solution supply trough providing fluid communication from each trough to the center cup of its associated rotatable brush therebelow.

In operation, the operator opens the control valve thereby permitting cleaning solution to flow into and fill the manifold. Fluid cascades from the manifold, through strategically located orifices in the bottom thereof, into the corresponding fluid supply troughs in the brush support beam. The cleaning solution then flows into the center cups of each rotary brush, through the appropriate fluid supply conduit, and is applied to the surface being cleaned through openings in the brush center cup bottom.

BRIEF DESCRIPTION OF THE DRAWINGS

FIG. 13 is a perspective view of one gear brush with all but one of the brush bristle bundles removed.

FIG. 14 is a bottom view of the gear brush illustrated in FIG. 13 with all but one of the brush bristle bundles removed.

FIG. 15 is a cross-sectional view taken along line 15—15 in FIG. 14 with all but one of the brush bristle bundles removed.

DETAILED DESCRIPTION OF THE INVENTION

Figure 1:
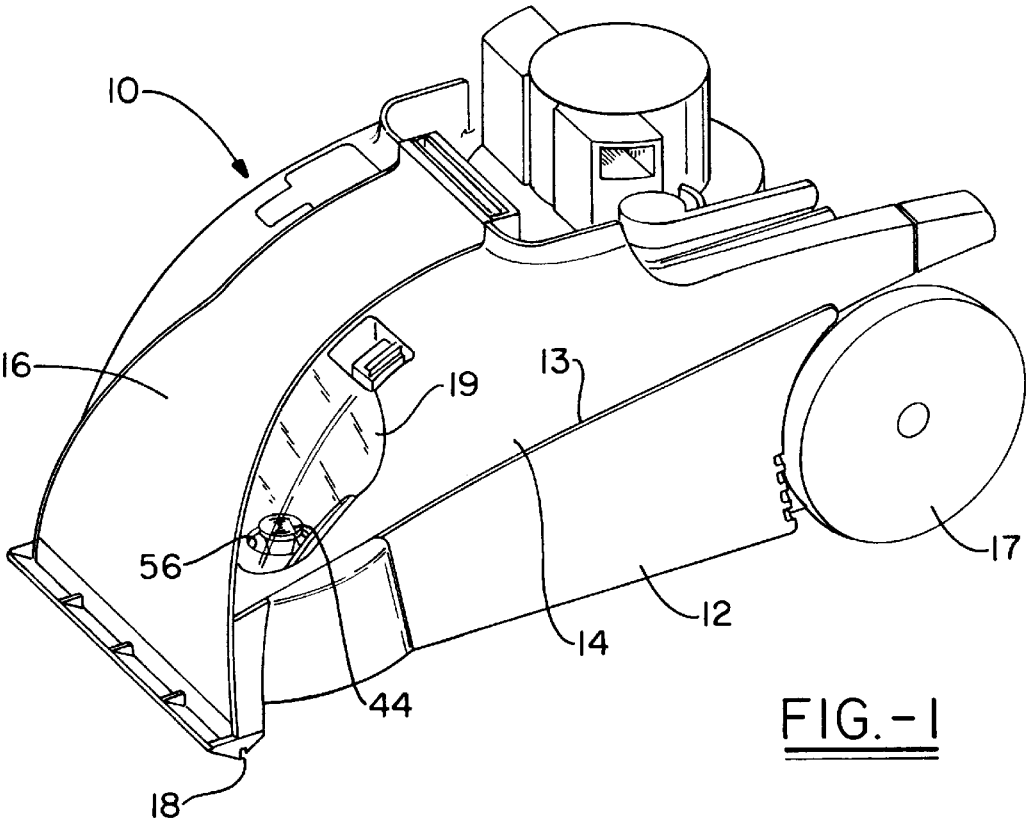
FIG. 1 is a perspective view of an upright carpet extractor base module incorporating the present invention.

Referring to FIG. 1, the present invention relates to a base module 10 for an upright carpet extractor. The upper portion of a typical upright carpet extractor suitable for use in combination with the herein described base module 10 may be found in co-owned U.S. Pat. No. 5,406,673 issued on Apr. 18, 1995, titled "Tank Carry Handle and Securement Latch", the contents of which are included herein by reference.

Base module 10 comprises a lower housing 12 and an upper housing 14 which generally separate along parting line 13. Suction nozzle 16 and suction inlet 18 are part of the upper housing 14 similar to the suction nozzle structure as taught in the above referenced co-owned patent.

Figure 2:
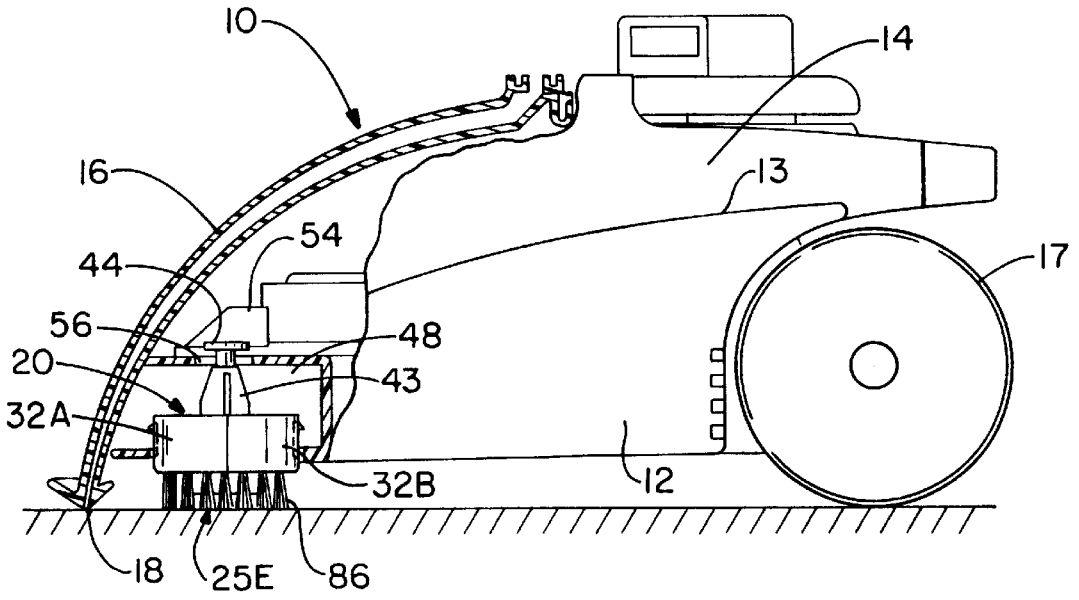
FIG. 2 is a left side elevational view of the base module, as seen in FIG. 1, having the forward portion thereof cut away to illustrate the general positioning of the brush assembly therein.
Figure 3:
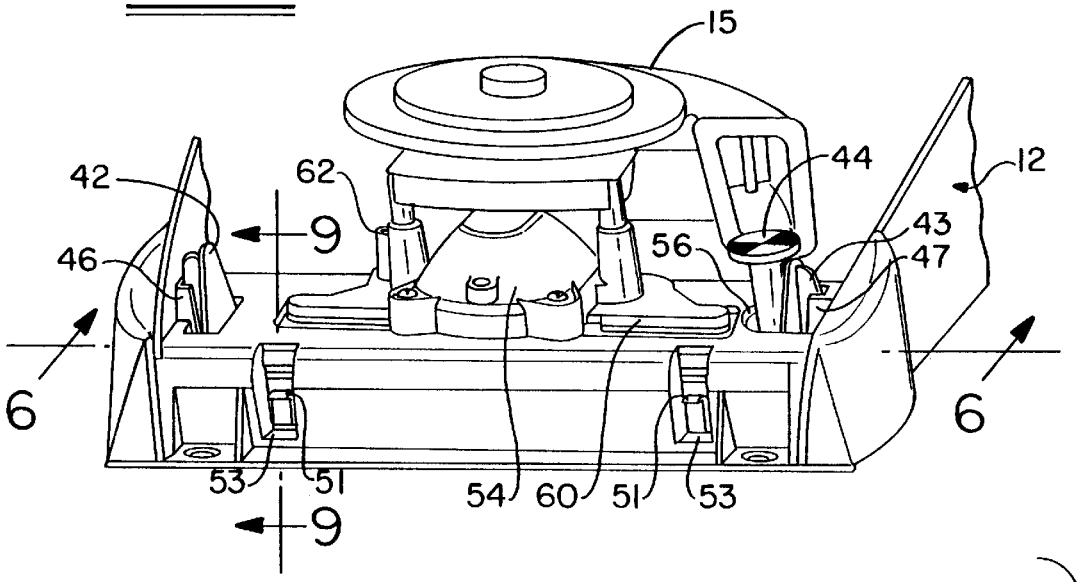
FIG. 3 illustrates the forward portion of the base module, illustrated in FIG. 1, having the top cover portion removed.
Figure 4:
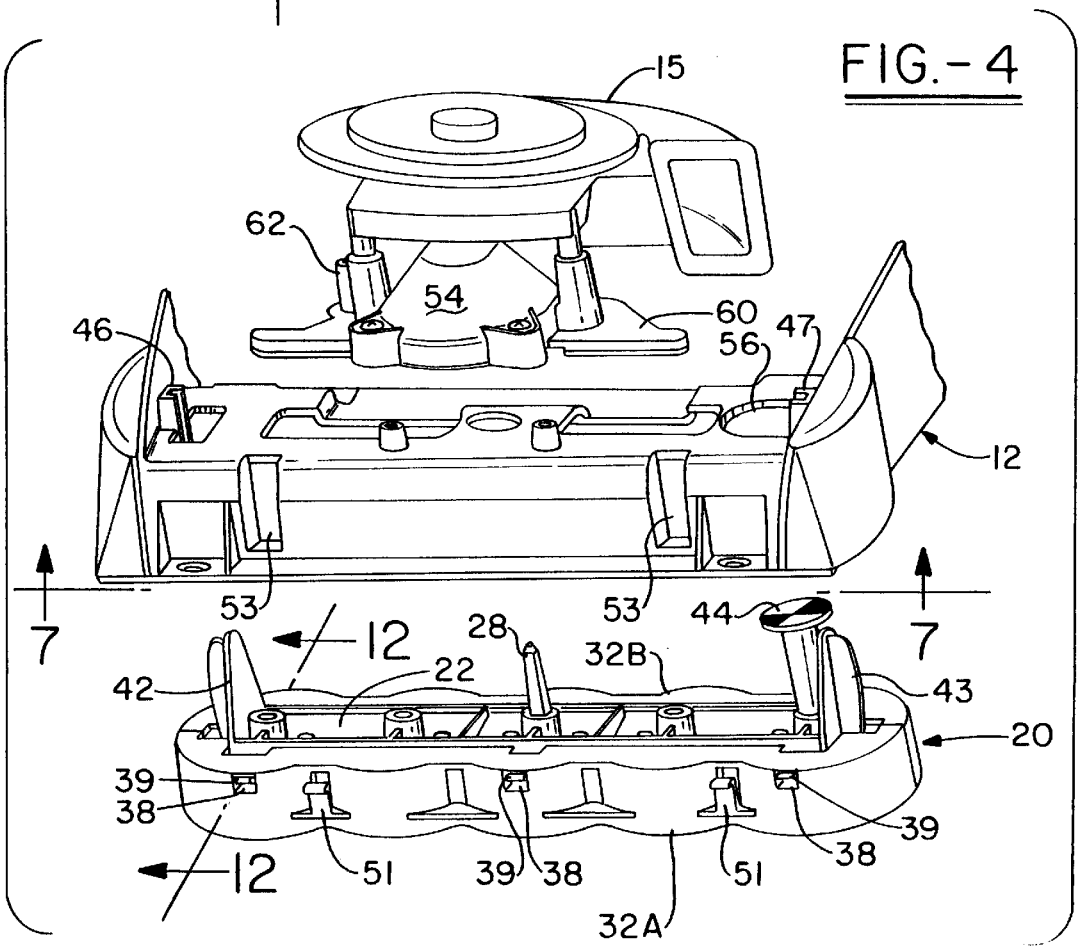
FIG. 4 is an exploded view illustrating the basic subassemblies which form the present invention.

As principally illustrated in FIGS. 2, 3, and 4, lower housing 12 has suspended therein a floating carpet scrubbing brush assembly 20. FIGS. 3 and 4 illustrate the forward portion of lower housing 12 with the upper housing, including the suction nozzle 16, removed for clarity. The brush assembly may be powered by an air driven turbine 15, or any other suitable motive power means typically used in the industry, through a suitable gear drive train or transmission 54. A suitable air turbine driven gear train is taught in co-owned U.S. Pat. No. 5,443,362 issued on Aug. 22, 1995 and titled "Air Turbine".

Figure 5:
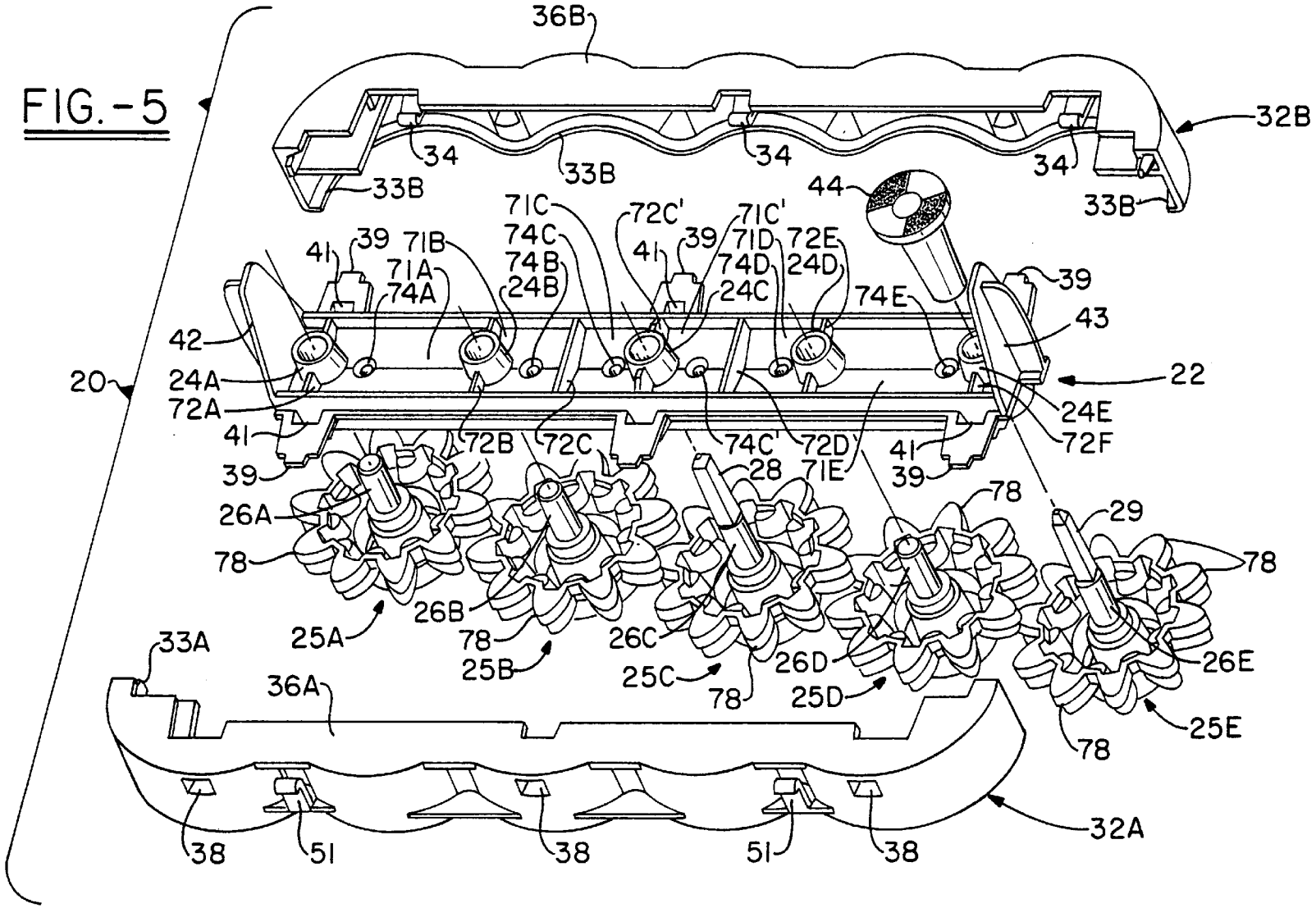
FIG. 5 is an exploded view of the brush assembly seen in FIG. 4.
Figure 6:
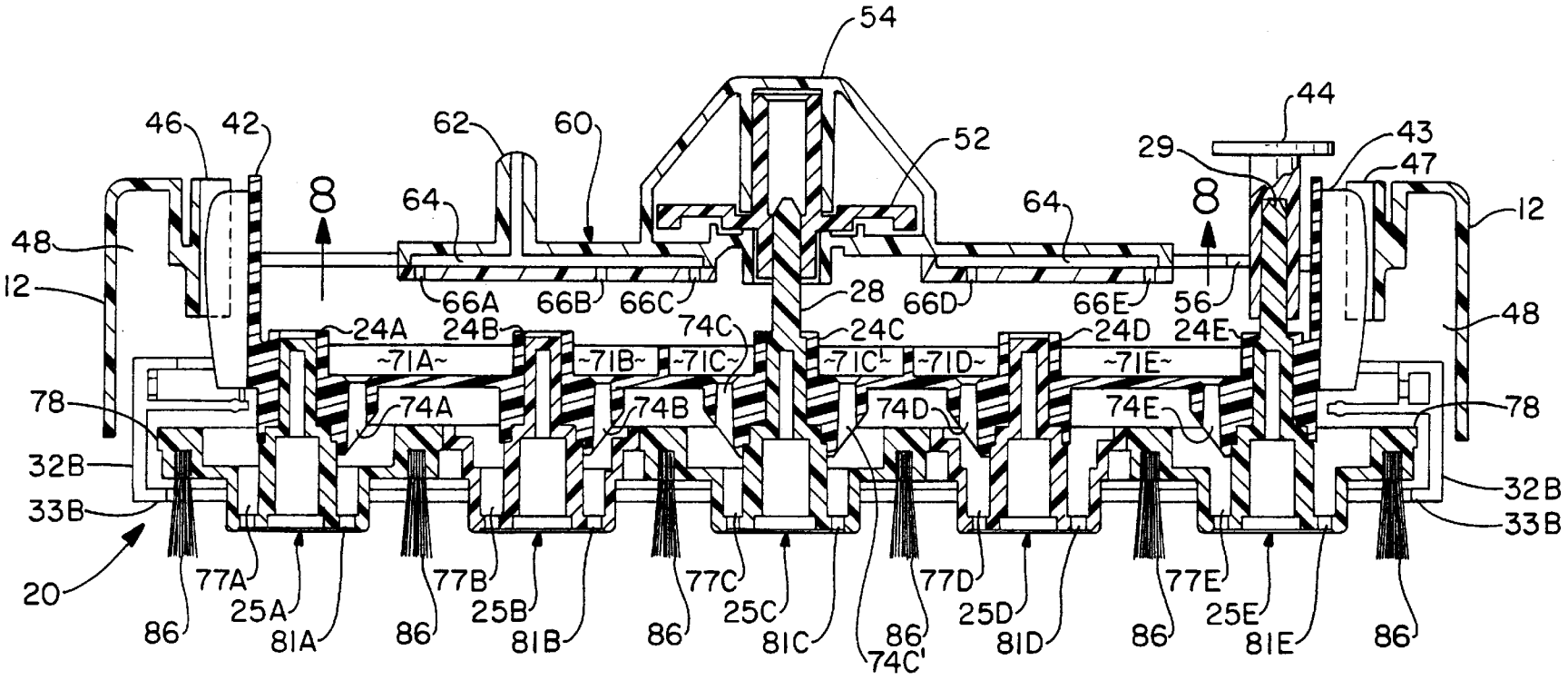
FIG. 6 presents a sectional view taken along line 6—6 in FIG. 3 showing the brush assembly in its lowest position.

Turning now to FIGS. 5 and 6, brush assembly 20 comprises brush support beam 22 having five spaced apart, integrally molded, cylindrical bearings 24A, 24B, 24C, 24D and 24E. Rotatingly received within bearings 24 are axial shafts 26A, 26B, 26C, 26D and 26E of gear brushes 25A, 25B, 25C, 25D and 25E. It is to be noted that the axial shafts of brush gears 25C and 25E include extensions 28 and 29, respectfully, for purposes to be described below.

During manufacture of brush assembly 20, the gear brush axial shafts 26 are first inserted into the appropriate bearing 24 and with gear brushes 25 in their uppermost position, with gear teeth 78 intermeshed, gear guards 32A and 32B are attached to support beam 22, as described below, thereby forming brush assembly 20, as illustrated in FIG. 4. Once assembled the peripheral lips 33A and 33B, on each gear guard 32A and 32B respectively, extend inwardly beyond the lower portion 84 (see FIG. 13) of gear teeth 78 thereby surrounding the row of rotary brushes and retaining each gear brush within the confines of the surrounding gear guards. Thus each brush may float vertically, with respect to support beam 22, limited in its uppermost travel by abutment of brush 25 with the lower portion of bearing 24 and limited in its lowermost travel by abutment of teeth 78 with lips 33 of gear guards 32. Also by providing a loose fit between the gear brush axial shaft 26 and bearing 24 each brush 25 may also tilt slightly with respect to the vertical axis.

In the illustrated preferred embodiment of the present invention, the gear brushes 25 including their integrally molded shaft 26 and the support beam 22 with its ingrally molded bearing guides 24 are both molded of polyester material. It has been found that molding both the gear brushes and support beam of polyester material provides dimensional stability in the presence of fluids and vapors, a low coefficient of friction between the gears and bearings and a high wear resistance. In addition, the polyester material is compatible with typical floor cleaning chemicals and obviates the need for bearing inserts and interfacing configuration of inserts. Further, the loose fitting between parts of the gear assembly guards against spin welding and damage resulting from crystalline materials and/or dirt. Still further, the one piece molding of the gear brushes 25 and drive shaft 26 provides extended durability over conventional multipiece bearing gear assemblies while providing simplicity and economy of manufacture.

Gear guards 32A and 32B are identical in construction so as to be interchangeable on either side of brush support beam 22. To facilitate "snap together" assembly of each gear guard to the brush support beam, each gear guard 32 is provided with three integrally formed, horizontally extending, locking tabs 34, as best seen on gear guard 32B in FIG. 5, extending parallel to and below the top cover plates 36A and 36B of gear guards 32A and 32B. Further each gear guard (32A and 32B) is provided guide and alignment openings 38 for receipt therein (upon assembling the brush assembly) of extended tabs 39 of brush support beam 22.

Figure 11:
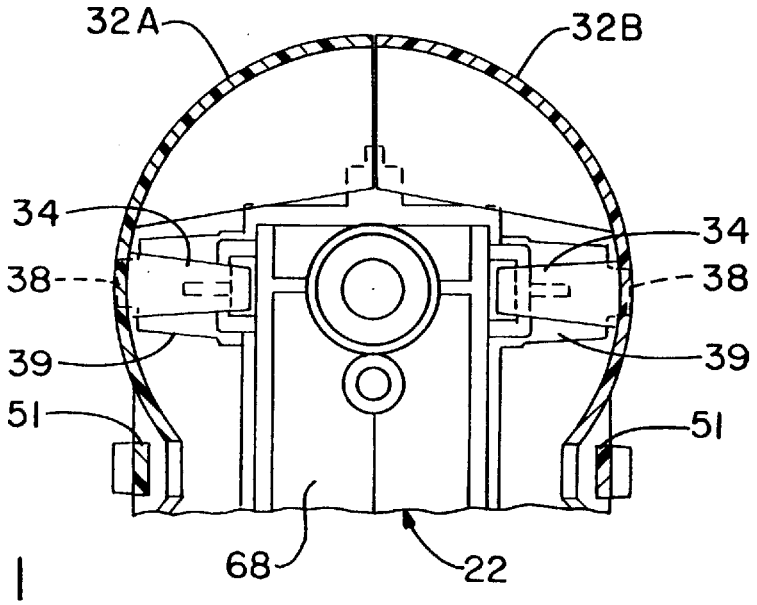
FIG. 11 is a sectional view taken along line 11—11 in FIG. 9.
Figure 12:
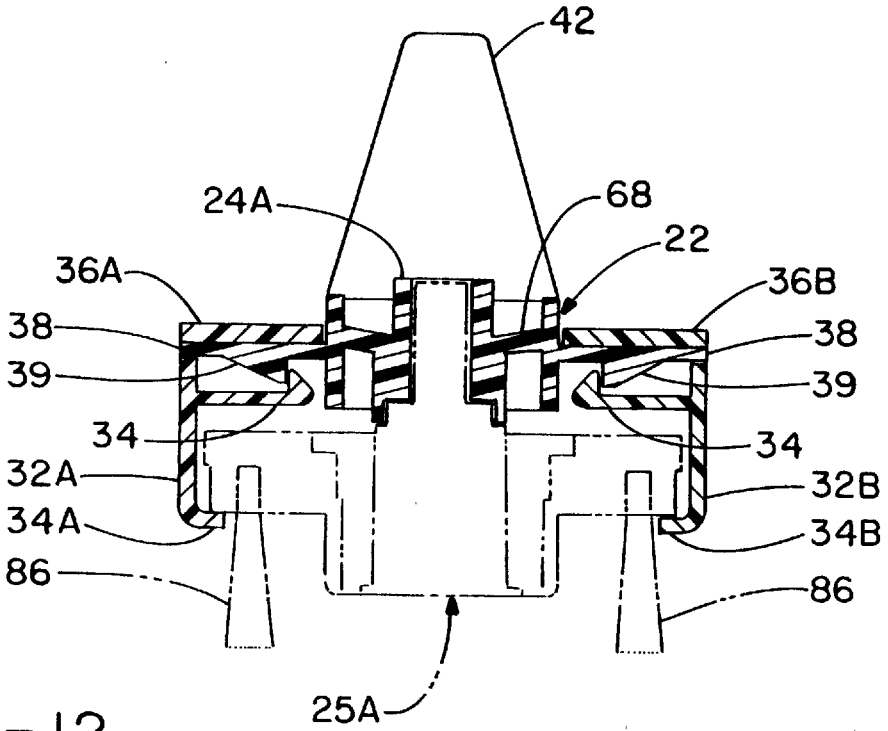
FIG. 12 is a sectional view taken along line 12—12 in FIG. 4 with the brushes shown in phantom.
Figure 17:
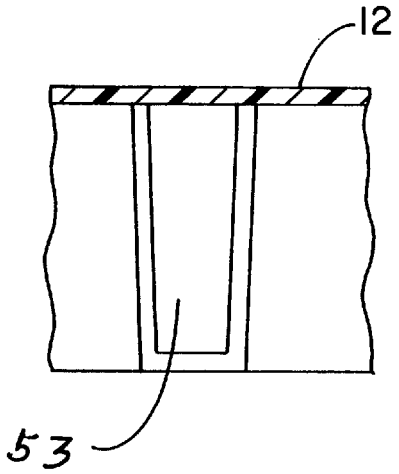
FIG. 17 is an elevational view taken along line 17—17 in FIG. 7.
Figure 16:
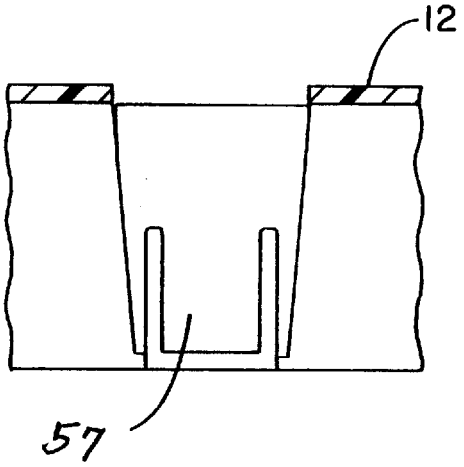
FIG. 16 is an elevational view taken along line 16—16 in FIG. 7.

As the gear guards are brought together about brush support beam 22 and its associated gear brushes 25, tangs 34, on both gear guards 32A and 32B, slide under extended tabs 39, of brush support beam 22, engaging slots 41 thereby locking gear guards 32A and 32B to brush support beam 22 as illustrated in FIGS. 11 and 12. It is to be noted that when assembled, extended tangs 39 are sandwiched between the gear guard top cover plate 36A and 36B and its associated tang 34, as seen in FIG. 12, thereby providing lateral stability to the gear guards.

Figure 9:
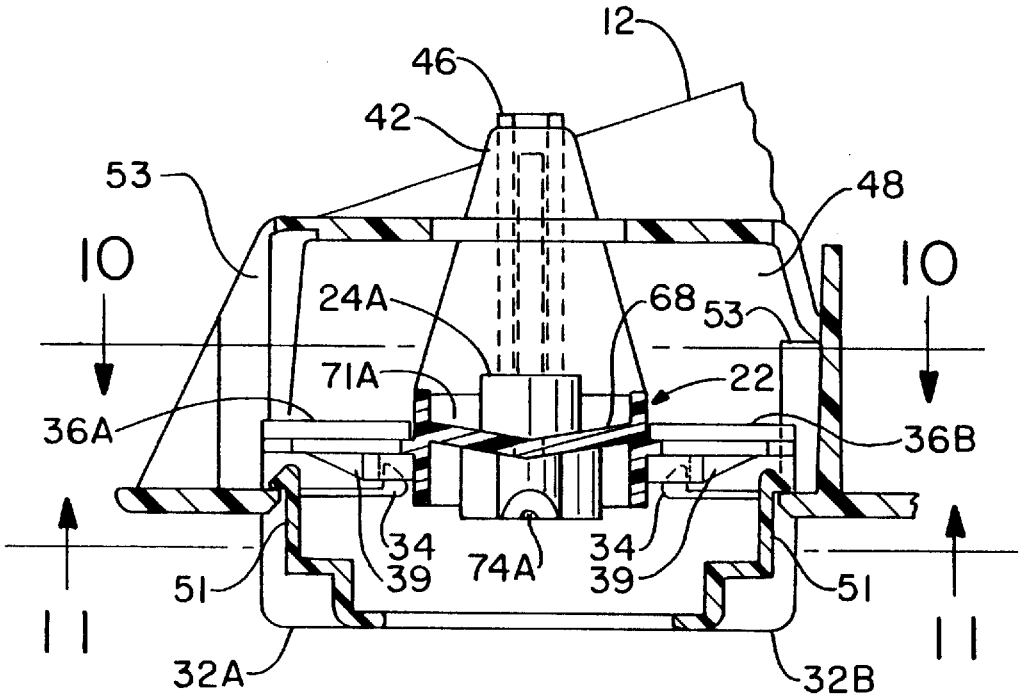
FIG. 9 is a sectional view as taken along line 9—9 in FIG. 3 with the brushes removed.
Figure 10:
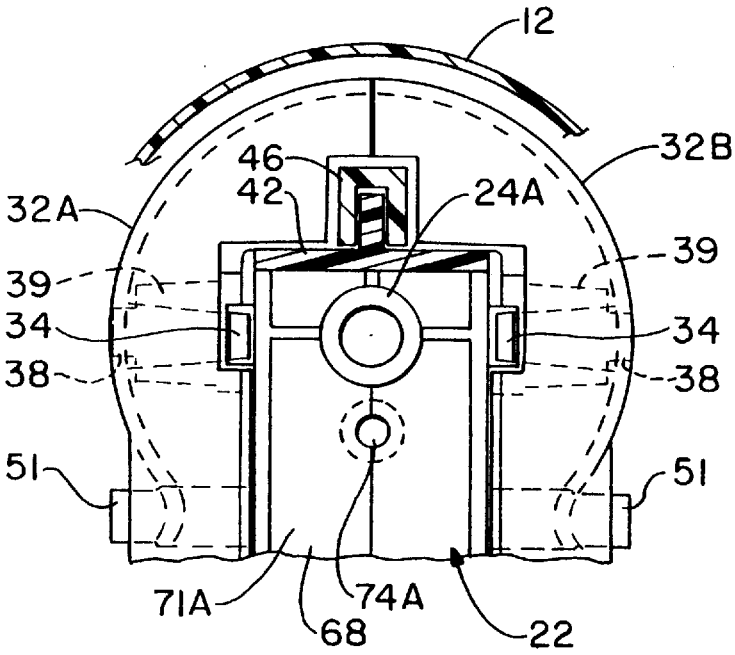
FIG. 10 is a sectional view taken along line 10—10 in FIG. 9.

Integral to and extending upward from the opposite lateral ends of brush support beam 22 are "T" shaped rails 42 and 43. T-rails 42 and 43 are slidably received within vertical guide slots 46 and 47 integrally molded into lower base module housing 12, as best seen in FIGS. 3, 9, and 10, whereby brush assembly 20 may freely move or float in the vertical direction within the brush assembly cavity 48 of housing 12.

During assembly of base module 10, brush assembly 20 is inserted vertically into cavity 48 with T-rails 42 and 43 slidably engaging guide slots 46 and 47 respectfully. As brush assembly 20 is inserted into cavity 48, tabs 51 on gear guards 32A and 32B snap into vertically elongated openings 53 and grooves 57 respectively of housing 12. As illustrated in FIGS. 2, 3, 9, 11, 16, and 17, outwardly projecting tangs 51 from gear guard 32A slidingly engage vertical slots 53 of housing 12 and tangs 51, projecting from gear guard 32B, slidingly engage grooves 57 thereby floatingly retaining brush assembly 20 within cavity 48.

Figure 6A:
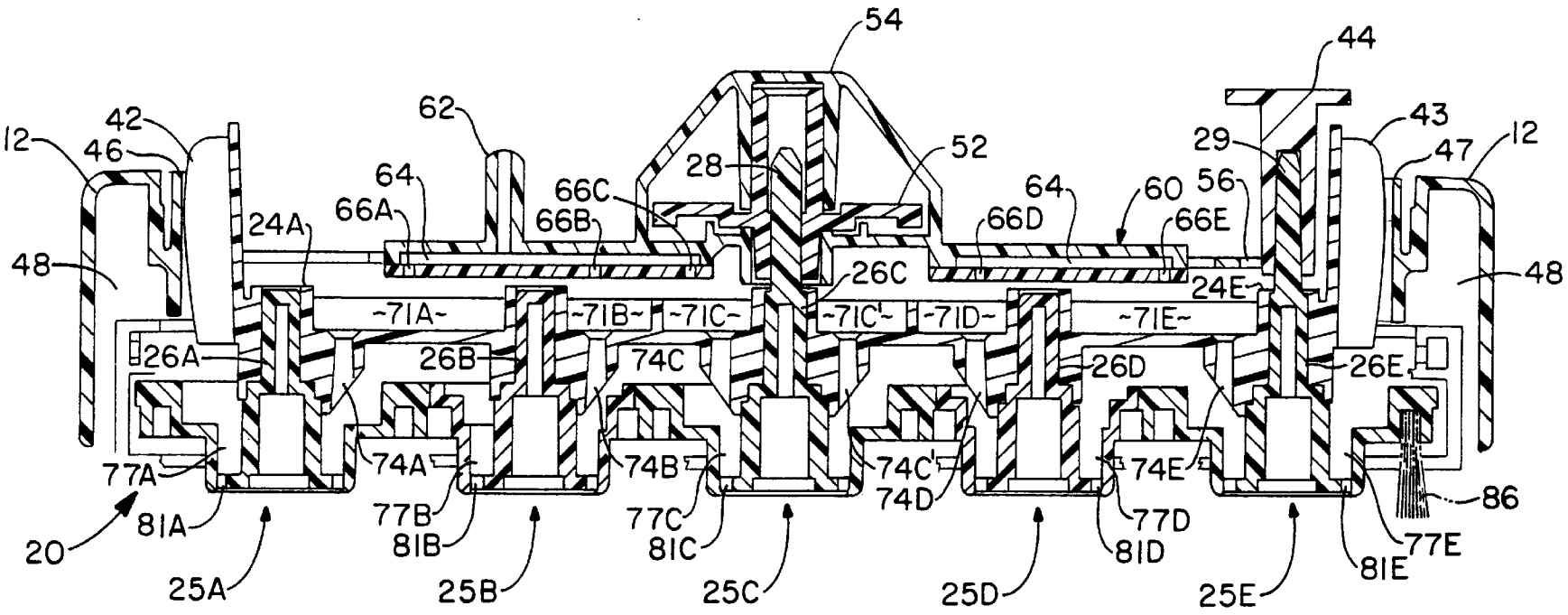
FIG. 6A presents a sectional view taken along line 6—6 in FIG. 3 showing the brush assembly in its uppermost position.

Gear brush 25C and 25E (see FIG. 5) are provided with axle shaft extensions 28 and 29, respectively, having a square lateral cross-section. Axle shaft 28 is slidably received within drive gear 52 contained within gear box 54 as illustrated in FIG. 6. Gear 52 is preferably powered by air turbine 15 through an appropriate gear train, such as that disclosed in co-owned U.S. Pat. No. 5,443,362 identified above and incorporated herein by reference. As brush assembly 20 moves vertically, with respect to lower housing 12, axle shaft 28 is slidably received within drive gear 52 as illustrated in FIG. 6A.

Gear brush rotation indicator 44 is fixedly attached to shaft extension 29 of gear brush 25E and extends upward through opening 56 in the top 45 of brush cavity 48 of lower housing 12 so as to be visible to the operator through clear lens 19 of upper housing 14 as seen in FIG. 1.

Referring to FIGS. 2, 9, 16, and 17, brush assembly 20 floats freely within cavity 48 of lower housing 12. The lower limit of brush assembly 20, as illustrated in FIG. 9, is controlled by tangs 51 which engage the bottom ledge 49 and 50 of slots 53 and grooves 57. The upper travel of brush assembly 20 is limited by abutment of the brush assembly against the top portion 45 of cavity 48.

Further, as brush assembly 20 floats vertically within cavity 48 T-rails 42 and 43 slidingly engaging slots 46 and 47 respectively of lower housing 12 thereby maintaining alignment of brush assembly 20 within cavity 48 and transferring the forces applied to brush assembly 20, by movement of extractor 10 forward and rearward, to lower housing 12. T-rails 42 and 43 are configured so as to permit brush assembly 20 to assume a laterally skewed or canted (one end higher than the other) relationship with respect to cavity 48 as it moves vertically.

Referring to FIGS. 1 and 2, base module 10 is principally supported upon rear wheels 17 and suction inlet 18 of suction nozzle 16. Thus brush assembly 20, by reason of the above described floating structure, is suspended within cavity 48 of lower housing 12 whereby brush assembly 20 bears none of the extractor weight and permits brushes 25 to "float" atop the surface being cleaned as they rotate. The weight of the extractor is supported by rear wheels 17 and suction inlet 18. With the extractor center of gravity forward of rear wheels 17 and the floating characteristic of brush assembly 20, suction inlet 18 will be in contact with the surface being cleaned thereby assuring maximum recovery of dispensed cleaning solution.

The structure described hereinabove is preferably constructed with generous and loose tolerances that permit brush assembly 20 as a unit and the individual gear brushes 25 to separately move in other than vertical straight lines and thereby operate in skewed positions as may be dictated by the unevenness of the surface being cleaned.

Figure 7:
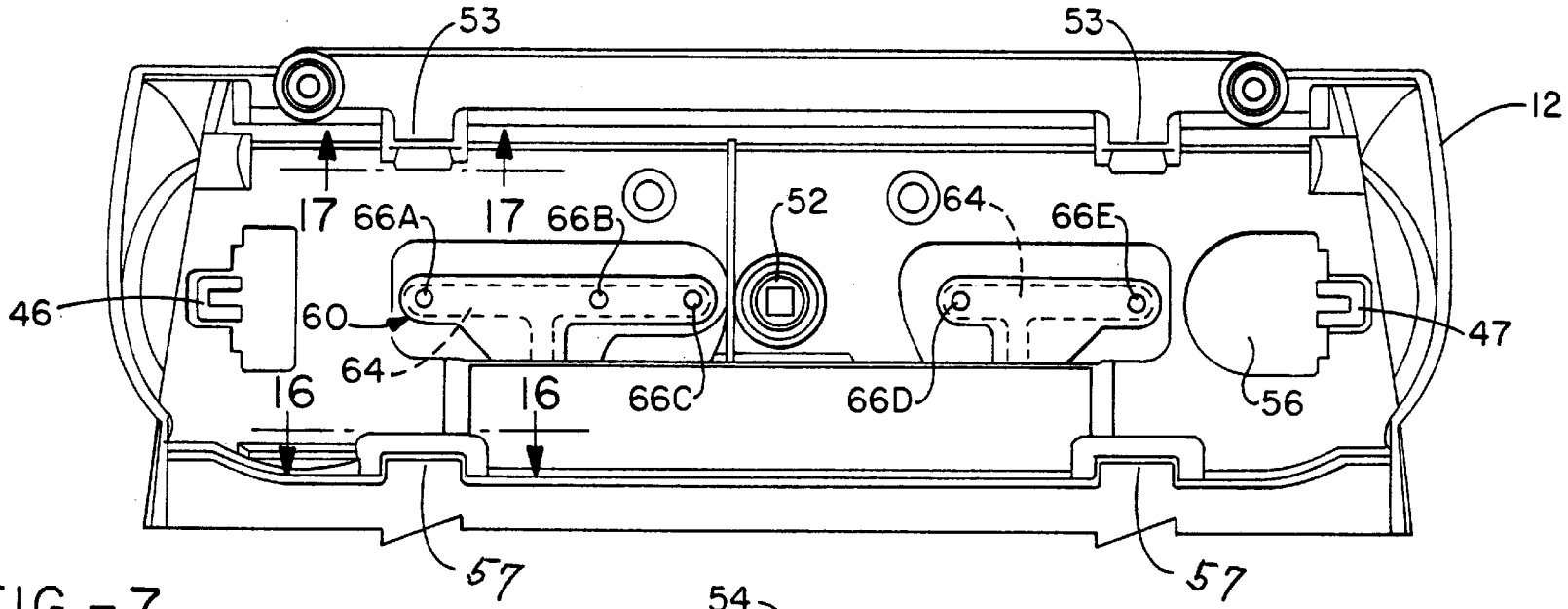
FIG. 7 is a bottom view as seen along line 7—7 in FIG. 4.
Figure 8:
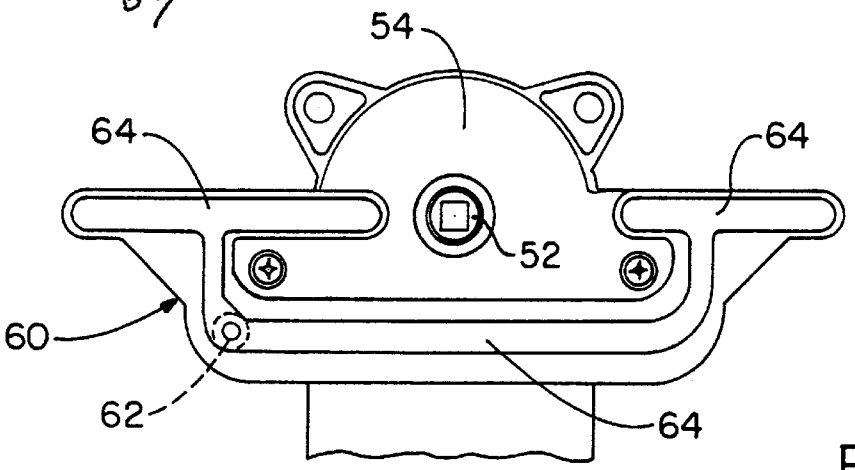
FIG. 8 is a sectional view taken along line 8—8 in FIG. 6.

Cleaning solution supply manifold 60 is positioned above brush assembly 20 and affixed to lower housing 12, as illustrated in FIGS. 3, 6, and 7. Liquid cleaning solution is supplied to nipple 62 on manifold 60 by way of a flexible tube such as, for example, illustrated in co-owned U.S. Pat. No. 5,406,673. The inside diameter of nipple 62 is a critical factor in controlling the cleaning solution flow rate through the solution supply system. Cleaning solution flows throughout manifold channel 64 to discharge orifices 66A, 66B, 66C, 66D and 66E in the bottom thereof as shown in FIGS. 7 and 8. Brush support beam 22 includes a laterally extending trough-like floor 68, as best seen in FIGS. 9 and 12, separated into five zones or troughs 71A, 71B, 71C, 71D, and 71E by walls 72A, 72B, 72C, 72D, 72E, and 72F as best illustrated in FIG. 5.

As can be seen in FIGS. 6 and 6A, liquid cleaning solution cascadingly flows, by gravity, from manifold orifice 66A into trough 71A, from orifice 66B into trough 71B, from orifice 66C into trough 71C, from orifice 66D into trough 71D and from orifice 66E into trough 71E. In the configuration as illustrated in FIGS. 6 and 6A, no fluid flows into trough 71C'. The purpose of trough 71C' is to provide symmetry to support beam 22 such that beam 22 requires no specific orientation during assembly. Beam 22 may be positioned as shown in the figures or rotated 180°. When rotated 180° trough 71C' then receives fluid from orifice 66C and supplies brush 25C through conduit 74C' with trough 71C becoming non-functional.

Cleaning solution received in troughs 71A, 71B, 71C, 71D, and 71E flows through fluid supply conduits 74A, 74B, 74C, 74D, and 74E, respectively, and into center cups 77A, 77B, 77C, 77D, and 77E of brushes 25A, 25B, 25C, 25D, and 25E as best seen in FIG. 6. Once deposited within brush cup 25, the cleaning solution flows outward toward the surface being cleaned through openings 81A, 81B, 81C, 81D, and 81E in the bottom of brush cups 77A, 77B, 77C, 77D, and 77E, respectively.

It is preferred that brush bristles 86 be of a soft texture such that when rotating and in contact with the surface being cleaned the brush bristles bend whereby the bottom of brush cup 77 is in contact with the surface being cleaned. Thus the cleaning solution being dispensed through openings 81 flows directly onto the surface being cleaned. A circumferential rim or edge 88 is provided about the bottom periphery of cup 77 to prevent the centrifuging of cleaning solution radially outward. The preferred operational speed of brushes 25 has been found to be between 500 to 900 RPM for a brush of approximately two inches in diameter.

For uniform distribution of cleaning solution on carpeted or other surfaces being cleaned, it is desirable that each brush 25A, 25B, 25C, 25D and 25E receive a steady and equal flow rate of cleaning solution. Therefore, the size of orifices 66A, 66B, 66C, 66D, and 66E are preferably determined by empirical testing. It has been found, for the manifold configuration as illustrated herein, that orifice 66B required a slightly larger diameter than that of the other four which are of equal size.

In order to minimize the lead-time required to stop the flow of cleaning solution to the brushes, conduits 74A, 74B, 74C, 74D, and 74E are oversized so as to be more than adequate to convey the flow rate being dispensed by orifices 66 into brush cups 77 thereby assuring that dispensed cleaning solution immediately flows through conduits 74 into brush cups 77 and exits through openings 81 onto the surface being cleaned and does not collect or back-up in troughs 71A, 71B, 71C, 71D, or 71E.

Referring to FIGS. 5, 13, 14, and 15, gear brushes 25C and 25E are identical to brushes 25A, 25B, and 25D in all respects except that brushes 25A, 25B, and 25D do not include key shaft 28 or 29. It is necessary for brush 25C to have extended key shaft 28 as it is the preferred, power driven gear brush which drives the gear brush train. Gear brush 25E includes key shaft 29 so that gear brush rotation indicator 44 may be placed thereon to provide visual verification to the operator that the gear brushes are, in fact, rotating during use.

Each gear brush 25 is basically configured as a spur gear preferably having ten teeth 78 which intermesh, as seen in FIGS. 5, 6, and 6A such that when center gear brush 25C rotates all other gear brushes rotate accordingly. The center hub of gear brushes 25 forms a hollow downwardly projecting cup 77 having a multiplicity of openings 81 circumscribing the bottom thereof.

Each gear tooth 78 has an upper tooth profile 82 and a lower profile 84 which approximates upper profile 82. However, profile 84 is smaller in size and slightly indented from profile 82, as seen in FIGS. 13, 14, and 15, forming an offset 83. Only profile 82 of gear tooth 78 is intended to drivingly engage the corresponding tooth profile of the adjacent gear brush.

Each gear tooth 78 has a blind bore 79, extending to offset 83, into which bristle bundles 86 are compressively inserted. Upon insertion of bristle bundles 86 into blind bores 79 lower profile 84 of tooth 78 may be expected to expand or bulge in the area of bore 79. Thus the offset 83 is sufficiently sized to prevent the bulge, in lower profile 84, from extending beyond the upper profile 82 and thus assuring that the gear teeth of adjacent gear brushes, upon intermeshing, do not bind or otherwise interfere with one another. Alternatively a downwardly extending circular (or any other convenient configuration) boss may be used to receive the bristle bundles and perform the function of alleviating gear binding.

The invention has been described with reference to the preferred embodiment having five rotary brushes. However, obvious modifications and alterations (including increasing or decreasing the number of brushes) will occur to others upon a reading and understanding of the specification. It is also to be understood that although the preferred embodiment disclosed hereinabove teaches rotary brushes having intermeshing spur gear configurations it is not to be considered outside the scope of our invention to use other types of brushes, such as a horizontal roll brush, and alternative drive means such as a belt drive etc. It is our intention to include all such modifications, alterations and equivalents in so far as they come within the scope of the appended claims or the equivalents thereof.

We claim:

1. In a floor scrubbing machine having a main body, a cleaning fluid delivery system, comprising:

a brush support carried by the main body;

at least one rotatable brush having a brush body and bristles extending from said brush body, said brush being carried by said brush support whereby the bristles of said brush engage the floor being scrubbed;

a fluid distributor carried by the main body above said brush support for distributing fluid supplied to said fluid distributor to said brush support;

a passage conveying said fluid from said brush support to said at least one brush; and wherein said brush support comprises a support beam movably carried by said main body and being disposed beneath said fluid distributor.

2. A delivery system in a floor scrubbing machine according to claim 1, wherein said fluid distributor comprises a chamber in selective fluid communication with a cleaning fluid reservoir, said chamber having at least one discharge orifice therein.

3. A delivery system in a floor scrubbing machine according to claim 1, wherein said at least one brush is movably carried by said support beam, said support beam having a trough for collecting cleaning solution as it falls from said fluid distributor, said trough having a fluid supply conduit disposed above said at least one brush.

4. A delivery system in a floor scrubbing machine according to claim 3, further comprising a plurality of brushes carried by said brush support and a plurality of walls disposed in said trough dividing said trough into a plurality of trough sections, each of said trough sections having at least one fluid supply conduit disposed above one of said brushes.

5. A delivery system in a floor scrubbing machine according to claim 1, wherein said brush body has a cup therein, said cup being disposed below said passage such that fluid falls from said passage into said cup.

6. A delivery system in a floor scrubbing machine according to claim 5, wherein said cup has at least one opening allowing any fluid in said cup to fall onto the surface being scrubbed.

7. A delivery system in a floor scrubbing machine according to claim 1, wherein fluid entering said fluid distributor may freely flow towards said brush support.

8. A delivery system in a floor scrubbing machine according to claim 1, wherein any fluid carried by said brush support may freely flow towards said brush body.

9. A delivery system in a floor scrubbing machine according to claim 1, wherein any fluid carried by said brush body may freely flow towards the surface being scrubbed.

10. In a floor scrubbing machine, a cleaning fluid application system comprising:

a) a housing;

b) a brush support movably attached to said housing and free to float with respect thereto;

c) at least one rotatable brush attached to said brush support whereby the bristles of said brush scrubbingly engage the surface being scrubbed;

d) a fluid distributor unmovably affixed to said housing and suspended above said brush support whereby fluid supplied thereto may pass from said fluid distributor to said brush support, e) a path for conveying fluid from said brush support to the surface being scrubbed; and f) a supply of fluid in communication with said fluid distributor.

11. The apparatus as claimed in claim 10, wherein said brush support comprises a laterally extending beam including a trough integral therewith, and a conduit associated with said brush for conveying cleaning solution from said trough to said brush.

12. The apparatus as claimed in claim 11 wherein said trough includes a multiplicity of separate troughs.

13. A hot water carpet extractor, comprising:

a) a main body housing;

b) a carpet scrubbing brush assembly floatingly attached to said main body, said assembly including a multiplicity of powered rotating brushes;

c) a fluid distributor positioned above said brushes for conveying fluid to each of said brushes;

d) a fluid supply manifold positioned above said brush assembly and affixed to said housing, said manifold having a multiplicity of orifices therein whereby fluid supplied to said manifold flows through said orifices to said fluid distributor; and e) means for supplying fluid to said manifold.

* * * * *